US009565955B2

(12) United States Patent
Suchman et al.

(10) Patent No.: US 9,565,955 B2
(45) Date of Patent: Feb. 14, 2017

(54) WATERPROOF PERFORATED LAYERED SHEET

(71) Applicants: Carol Suchman, New York, NY (US); Maxwell Cohen, New York, NY (US)

(72) Inventors: Carol Suchman, New York, NY (US); Maxwell Cohen, New York, NY (US)

(73) Assignee: Afresheet LLC, New York, NY (US)

( * ) Notice: Subject to any disclaimer, the term of this patent is extended or adjusted under 35 U.S.C. 154(b) by 0 days.

(21) Appl. No.: 14/036,040

(22) Filed: Sep. 25, 2013

(65) Prior Publication Data

US 2014/0215715 A1 Aug. 7, 2014

Related U.S. Application Data

(60) Provisional application No. 61/718,816, filed on Oct. 26, 2012, provisional application No. 61/814,558, filed on Apr. 22, 2013.

(51) Int. Cl.

| | |
|---|---|
| ***A61F 13/534*** | (2006.01) |
| ***A61F 13/15*** | (2006.01) |
| ***A47G 9/02*** | (2006.01) |
| ***A47C 31/10*** | (2006.01) |

(52) U.S. Cl.
CPC ..... *A47G 9/0246* (2013.01); *A47C 31/105* (2013.01)

(58) Field of Classification Search
CPC ..... A61F 5/485; A61F 13/534; A61F 13/15
USPC ..... 5/501, 500, 484, 487, 488, 499
See application file for complete search history.

(56) References Cited

U.S. PATENT DOCUMENTS

| | | | | |
|---|---|---|---|---|
| 1,275,205 | A | 8/1918 | Bigham | |
| 1,942,287 | A * | 1/1934 | Heitz | 206/447 |
| 2,351,767 | A | 6/1944 | Johnson | |
| 3,654,059 | A | 4/1972 | Zisblatt | |
| 3,761,973 | A * | 10/1973 | Leventhal | 5/484 |
| 4,903,361 | A * | 2/1990 | Tang | 5/502 |
| 5,144,911 | A | 9/1992 | Moore | |
| 5,685,257 | A | 11/1997 | Feibus | |
| 5,701,617 | A * | 12/1997 | Colby | 5/484 |
| 5,727,266 | A | 3/1998 | Pang | |
| 6,209,156 | B1 * | 4/2001 | Hershey | 5/490 |
| 6,233,762 | B1 * | 5/2001 | Bradley | 5/484 |
| 6,381,779 | B1 * | 5/2002 | Thompson | 5/502 |
| 7,013,509 | B2 | 3/2006 | Hickman | |
| 7,120,952 | B1 * | 10/2006 | Bass et al. | 5/484 |
| 7,370,380 | B2 * | 5/2008 | DeFranks et al. | 5/691 |
| 8,307,478 | B2 | 11/2012 | Patterson | |
| 2002/0124313 | A1 * | 9/2002 | Cook et al. | 5/484 |
| 2005/0177942 | A1 * | 8/2005 | Finn | 5/499 |

(Continued)

*Primary Examiner* — Peter M Cuomo
*Assistant Examiner* — Ifeolu Adeboyejo
(74) *Attorney, Agent, or Firm* — Gottlieb, Rackman & Reisman, P.C.

(57) ABSTRACT

A layered mattress protector and sheet, comprising: a bottom fitted portion; at least three fitted sheet layers, each fitted sheet layer having a top side, bottom side, right side and left side and an upper portion and lower portion; a waterproof coating on the lower portion of each of the at least three fitted sheet layers; wherein the at least three fitted sheet layers are stitched along the right side and left side to the bottom fitted portion and the top side and bottom side are unstitched; and wherein each of the at least three fitted sheet layers has at least one perforation that is at least substantially parallel to the right side and left side in each of at least three fitted sheet layers.

13 Claims, 9 Drawing Sheets

(56) References Cited

U.S. PATENT DOCUMENTS

| | | | | |
|---|---|---|---|---|
| 2007/0094794 | A1* | 5/2007 | Ellis | 5/482 |
| 2009/0119840 | A1* | 5/2009 | Seo | 5/487 |
| 2009/0144900 | A1* | 6/2009 | Marrache | 5/484 |
| 2009/0205134 | A1* | 8/2009 | Wootten, Jr. | 5/488 |
| 2010/0154119 | A1* | 6/2010 | Shuttleworth | 5/484 |
| 2011/0214233 | A1* | 9/2011 | Stang | 5/488 |

* cited by examiner

WATERPROOF PERFORATED LAYERED SHEET

This application claims priority to provisional patent application No. 61/718,816 filed Oct. 26, 2012, 2012 and entitled "REMOVABLE LAYERED SHEET" and provisional patent application No. 61/814,558 filed Apr. 22, 2013 and entitled, "REMOVABLE LAYERED SHEET," the entire contents of which are incorporated herein by reference.

There are over 7.4 million college freshmen and sophomore students in the United States alone. And every year, new students enter the system, so there is a constant influx of students.

College students are known for their 'sloppy' lifestyle and many do not adhere to the cleanliness standards they had at home. This is due to a parent, house cleaner or other taking care of many of their needs. One of the needs is the changing of sheets that requires one to take everything off the bed, take off the fitted sheet and take it to the laundry to wash. This can take hours to wash and dry, bring it back to the dorm and remake the sheets. Or, you can send it out which can take a week to get back, so you need a second fitted sheet. Some students end up not washing their sheets all semester.

A dorm (college, high school or ever summer camp) is a hotbed for germs and dirt. Most students not only sleep in their bed, but use it for a workspace, kitchen table, drinking pub, guest lounge and guestroom for romantic encounters and a napping place. Food, dirt and bodily fluids cover the sheets, but they continue to use them without cleaning.

The present invention solves this problem by providing a layered sheet that has layers of perforated sheets that may be easily removed to reveal a new, fresh, clean layer without having to go through the hassle of cleaning sheets. The sheets can be crib sized, twin, double, queen, king, california king, hospital bed size or even dog bed sized/shaped. The fabric may be dyed any color and can be printed with any logo, such as a sports team, college name or even dates for reminders when to change the sheets (e.g. October 1, October 15, November 1).

These and other features, aspects and advantages of the present invention will become better understood with reference to the following description and claims.

SUMMARY OF THE INVENTION

The present invention relates generally to a layered mattress protector and methods of manufacturing a layered mattress protector.

According to aspect of the present invention, a layered mattress protector and sheet is provided, comprising: a bottom fitted portion; at least three fitted sheet layers, each fitted sheet layer having a top side, bottom side, right side and left side and an upper portion and lower portion; a waterproof coating on the lower portion of each of the at least three fitted sheet layers; wherein the at least three fitted sheet layers are stitched along the right side and left side to the bottom fitted portion and the top side and bottom side are unstitched; and wherein each of the at least three fitted sheet layers has at least one perforation that is at least substantially parallel to the right side and left side in each of at least three fitted sheet layers.

According to another aspect of the present invention, a method of manufacturing a layered mattress protector and sheet is provided, comprising the steps of: providing a bottom fitted portion; providing at least three fitted sheet layers, each fitted sheet layer having a top side, bottom side, right side and left side and an upper portion and lower portion, wherein the lower portion of each of the at least three fitted sheet layers has a waterproof coating; providing at least one perforation that is at least substantially parallel to the right side and left side in each of at least three fitted sheet layers; stitching the at least three fitted sheet layers along the right side and left side to the bottom fitted portion and leaving the top side and bottom side unstitched.

These and other features, aspects and advantages of the present invention will become better understood with reference to the following description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 6:
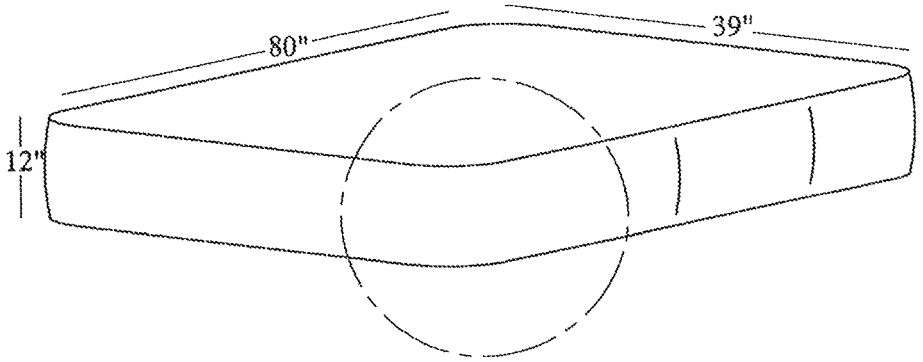
FIG. 6 depicts a layered mattress protector according to the present invention.
Figure 7:
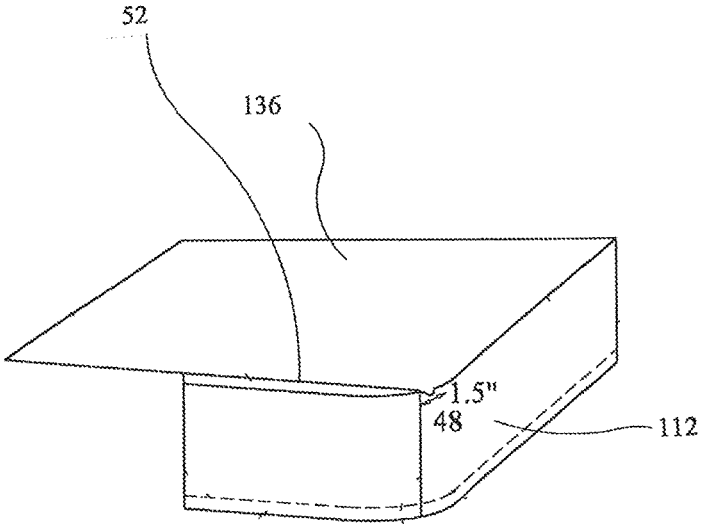
FIG. 7 depicts a layered mattress protector according to the present invention.
Figure 8:
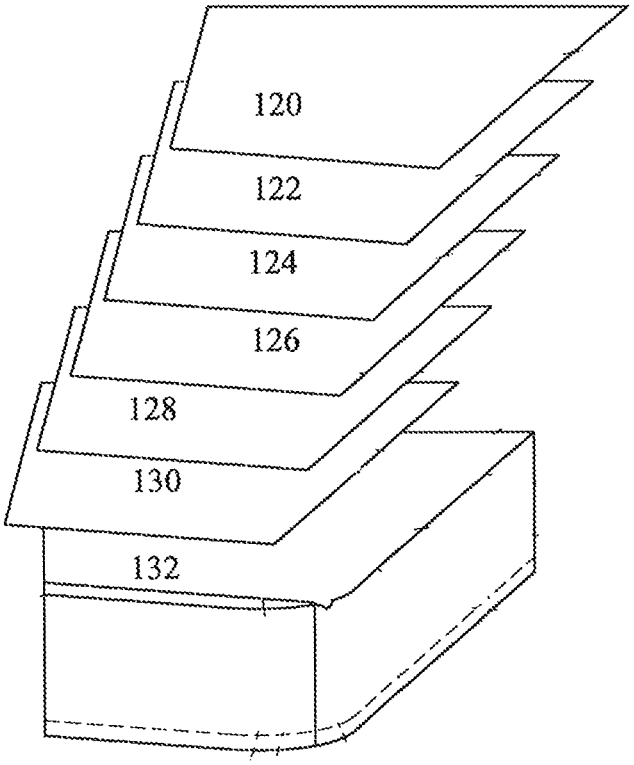
FIG. 8 depicts a layered mattress protector according to the present invention.
Figure 9:
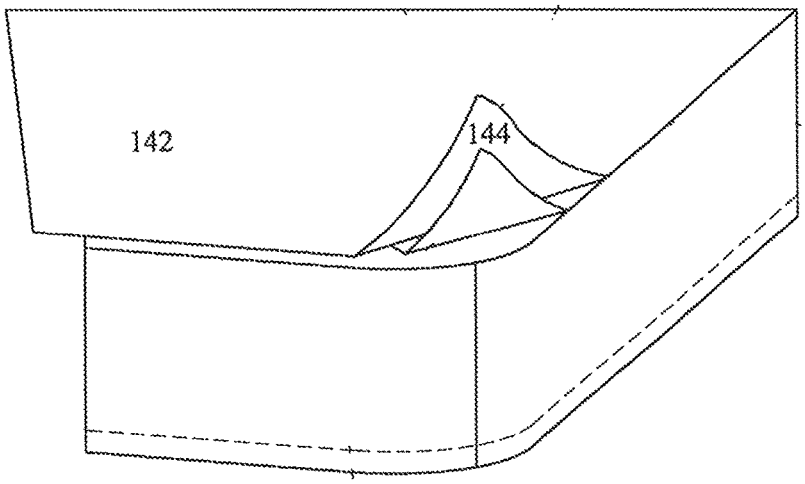
FIG. 9 depicts a layered mattress protector according to the present invention.
Figure 10:
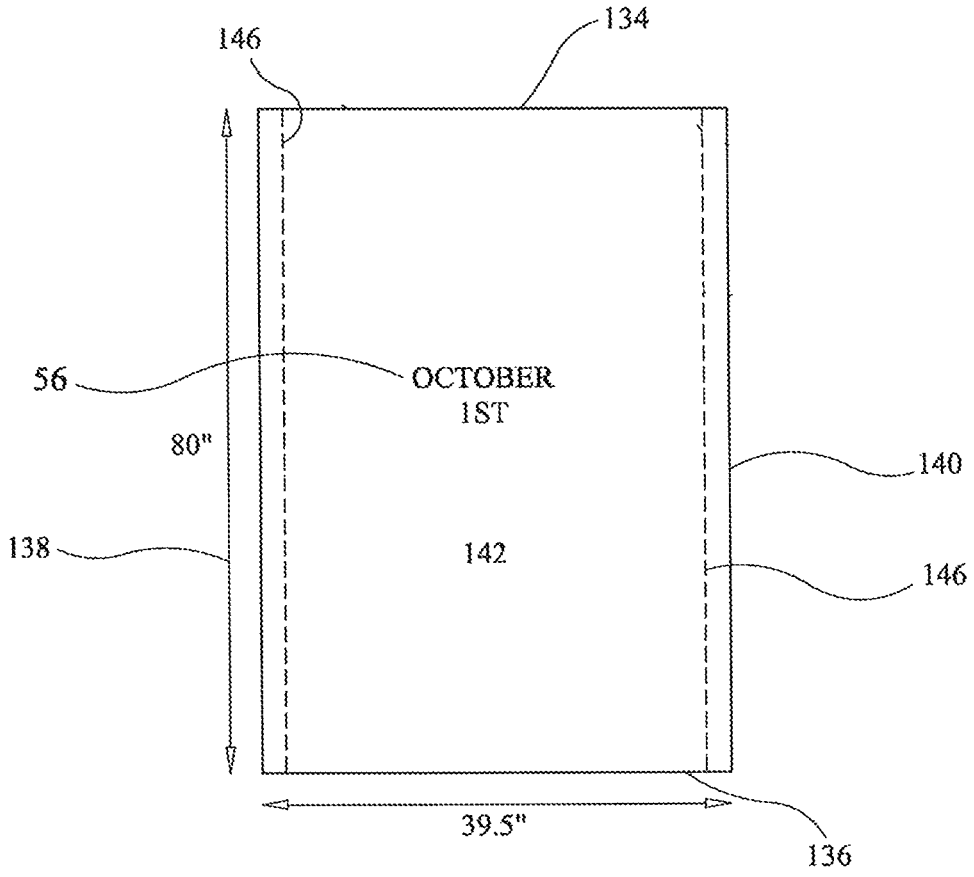
FIGS. 10 and 11 depict a layered mattress protector according to the present invention.

With reference to FIGS. 1-10, the present invention provides a layered mattress protector and sheet (10). It is noted that two embodiments are shown. FIGS. 1-5 depict one embodiment having a perforation that runs substantially parallel to the top side (34), bottom side (36), right side (40) and left side (38) and includes a tab (50). FIGS. 6-8 depict a preferred embodiment, in which there are only two perforations, that are perforation seams (80), that are substantially parallel to the right side and left side in each of at least three fitted sheet layers. They are also slightly inside the right side and left side of each of the at least three fitted sheet layers, which is to say they are located closer to the center point of each of the at least three fitted sheet layers. The layered mattress protector and sheet may have a bottom fitted portion (12, 112); at least three fitted sheet layers (e.g. 20, 22, 24, 26, 28, 30, 32, 120, 122, 124, 126, 128, 130 and 132). While there may be any number of fitted sheet layers, according to one preferred embodiment there are seven layers. Each fitted sheet layer has a top side (34, 134), bottom side (36, 136), right side (40, 140) and left side (38, 138) and an upper portion (42, 142) and lower portion (44, 144). Note that the numbers for the different sides are shown for one layer of the many layers of the fitted sheet layers. Each layer would have the same sides. There may be a waterproof polyethylene coating on the lower portion (44, 144) of each of the at least three fitted sheet layers. It should be understood that a waterproof layer would be equivalent to a waterproof coating and the terms are interchangeable. The upper portion of each fitted sheet layer may be rayon (also referred to as spunlace rayon). The at least three fitted sheet layers are stitched along the right side (40, 140) and left side (38, 138) to the bottom fitted portion (12, 112) and the top side (34, 134) and bottom side (36, 136) are unstitched. Each of the at least three fitted sheet layers has at least one perforation (46, 146). According to one embodiment, depicted in FIGS. 1-5, there is a single perforation that runs substantially parallel to the top side (34), bottom side (36), right side (40) and left side (38) and includes a tab cutout portion (50). The term perforation may be a series of small holes that allows for the fitted sheet layers to be removably attached, it may also be a perforation seam, that is a seam that is stitched creating holes, or perforations, yet having the added stability of a seam. The perforation (46, 146 also referred to as a perforation seam) creates a portion of the fitted sheet layer that is smaller than the entire fitted sheet layer that may be easily removed to reveal another, new fitted sheet layer below it. There is also a waterproof coating on the lower portion (44, 144) of each of the at least three fitted sheet layers. The at least three fitted sheet layers are stitched along the right side (40, 140) and left side (38, 138) to the bottom fitted portion (12, 112) and the top side (34, 134) and bottom side (36, 136) are unstitched. Each of the at least three fitted sheet layers has at least one perforation (46, 146) that is at least substantially parallel to the right side and left side in each of at least three fitted sheet layers.

The at least three fitted sheet layers may be stitched along the right side (40, 140) and left side (38, 138) to the bottom fitted portion (12, 112) along a portion of the right side (40, 140) and a portion of the left side (38, 138) to leave an unstitched portion (48) along a portion of each end of the right side and the left side. The unstitched portion (48) along a portion of each end of the right side and the left side may be between one and three inches, preferably one and a half inches. This allows for the easy removal of each layers of the at least three fitted sheet layers. It is not required that the unstitched portion (48) be along both sides, it may be along either a portion of the right side (40, 140) or a portion of the left side (38, 138). It should be towards one end of the right (right side (40, 140) or the left side (38, 138). The term end is intended to denote the area close the to the top side (34, 134) or the bottom side (36, 136). The unstitched portion (48) along a portion of at least one end of the right side and the left side may be between one and three inches, preferably one and a half inches.

Figure 1:
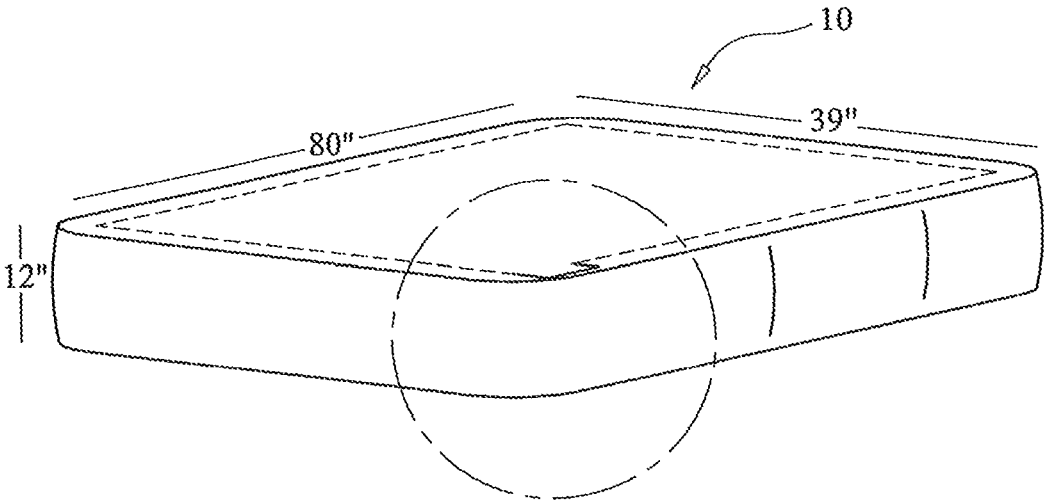
FIG. 1 depicts a layered mattress protector according to the present invention.
Figure 2:
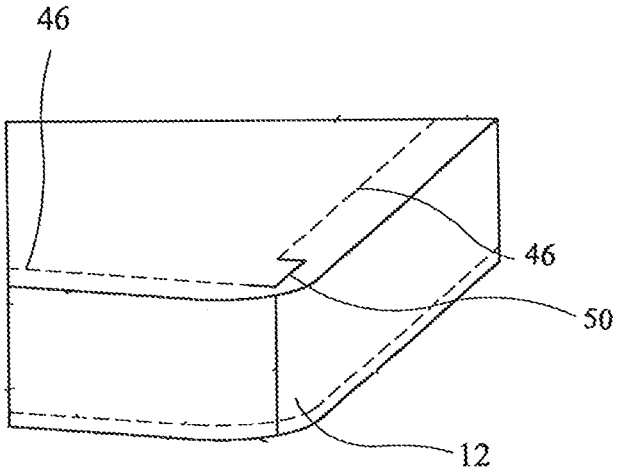
FIG. 2 depicts a layered mattress protector according to the present invention.
Figure 3:
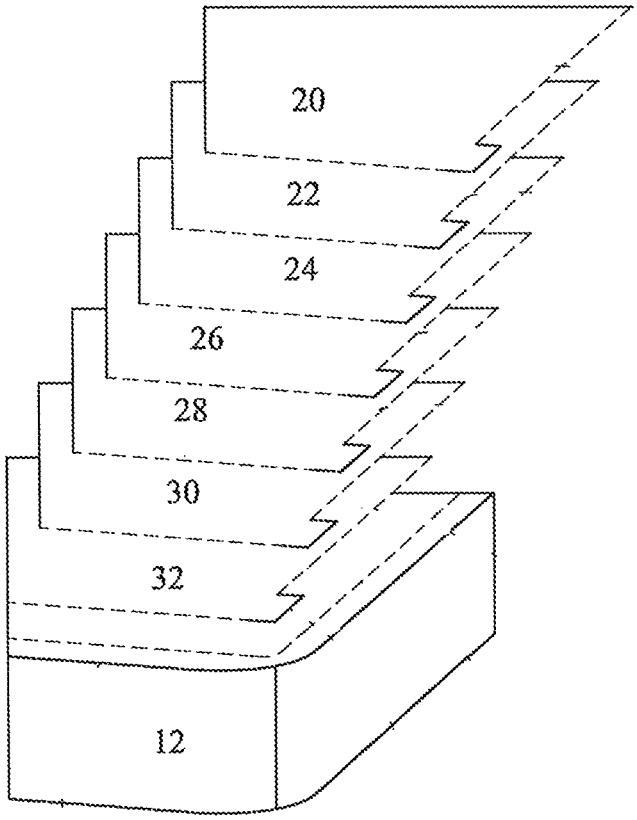
FIG. 3 depicts a layered mattress protector according to the present invention.
Figure 4:
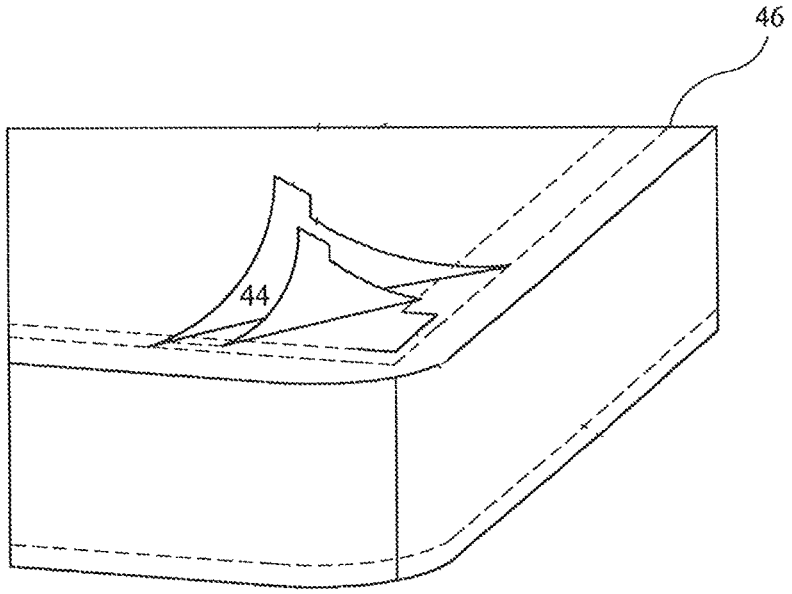
FIG. 4 depicts a layered mattress protector according to the present invention.
Figure 5:
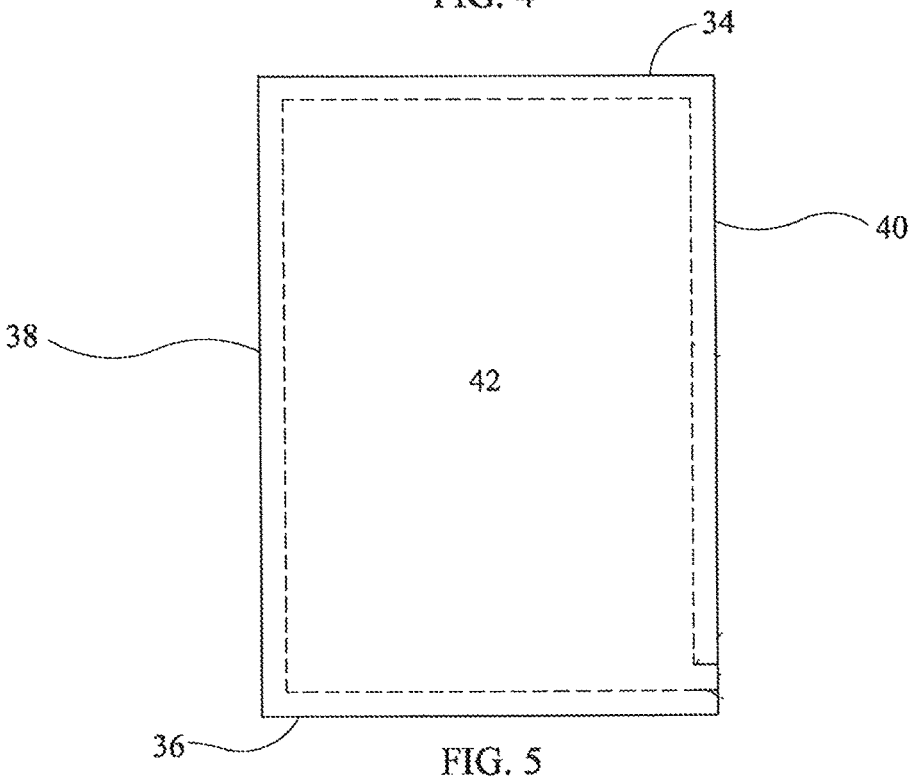
FIG. 5 depicts a layered mattress protector according to the present invention.

The upper portion (42) of each fitted sheet layer may any fabric that is desirable to the user, such as polyester and/or rayon fiber. The fitted sheet layers may be all the same size. According to an alternate embodiment, each of the at least three fitted sheet layers is slightly larger than the layer that is below it. As shown in FIG. 3, fitter sheet layer (20) is the biggest and has a perforation at 38⅞×29⅞, fitted sheet layer (22) is slightly smaller and has a perforation at 38⅝×29⅝, fitted sheet layer (24) is slightly smaller and has a perforation at 38⅝×29⅝, fitted sheet layer (26) is slightly smaller and has a perforation at 38⅝×29⅝, fitted sheet layer (28) is slightly smaller and has a perforation at 38⅜×29⅜, fitted sheet layer (30) is slightly smaller and has a perforation at 38⅜×29⅜ and fitted sheet layer (32) is slightly smaller and has a perforation at 38⅛×29⅛. As can be seen each perforated portion of the at least three fitted sheet layers is slightly larger than the layer that is below it.

Each perforated portion, according to an alternate embodiment, may have a tab cutout portion (50). The tab cutout portion (50) may be between a portion of the perforated portion (46) and at least one of the top side (34), bottom side (36), right side (40) and left side (38) of the at least three fitted sheet layers. According to one embodiment, the tab cutout portion (50) is away from the top side (34). This is to prevent inadvertent removal of a layer and any possible discomfort to the user. The top side (34) may be sewn with a rounded stitch that edges the top side to provide an edged top side. The top side (34) may also be stitched to provide a stitched rolled hem top side (54). There may also be a printed item (56) on the upper portion of the at least three fitted sheet layers. The printed item (56) may be a school logo, or it may be, by way of example, say "October" as a reminder to pull off the layer at the end of October. Of course, it could say October 1, the next layer October 15, the next layer November 1, etc. In this way, the user is reminded of when to change their sheets.

Another aspect of the present invention provides a method of method of manufacturing a layered mattress protector and sheet, comprising: providing a bottom fitted portion (12, 112); providing at least three fitted sheet layers (e.g. 20, 22, 24, 26, 28, 30, 32, 120, 122, 124, 126, 128, 130 and 132), each fitted sheet layer having a top side (34, 134), bottom side (36, 136), right side (40, 140) and left side (38, 138) and an upper portion (42, 142) and lower portion (44, 144), wherein the lower portion (44, 144) of each of the at least three fitted sheet layers has a waterproof coating; providing at least one perforation (46, 146) that is at least substantially parallel to the right side and left side in each of at least three fitted sheet layers; stitching the at least three fitted sheet layers along the right side and left side to the bottom fitted portion and leaving the top side and bottom side unstitched. The step of stitching the at least three fitted sheet layers along the right side (40, 140) and left side (38, 138) to the bottom fitted portion (12, 112) and leaving the top side (34, 134) and bottom side (36, 136) unstitched may be further comprising the step of: stitching along the right side and left side to the bottom fitted portion to leave an unstitched portion (48) along at least one end of the right side and the left side. The unstitched portion (48) along at least one end of the right side and the left side is between one and three inches, preferably one and a half inches. Each of the at least one perforations (46, 146) of the at least three fitted sheet layers may be slightly larger than the layer that is below it. There may be the step of providing a tab cutout portion (50). The tab cutout portion (50) may be along at least one of the top side, bottom side, right side and left side of the at least three fitted sheet layers. There may be the step of sewing the top side with a rounded stitch that edges the top side to provide an edged top side. There may be the step of stitching the top side to provide a stitched rolled hem top side. There may also be the step of printing a printed item (56) on the upper portion of each of the at least three fitted sheet layers.

Figure 11:
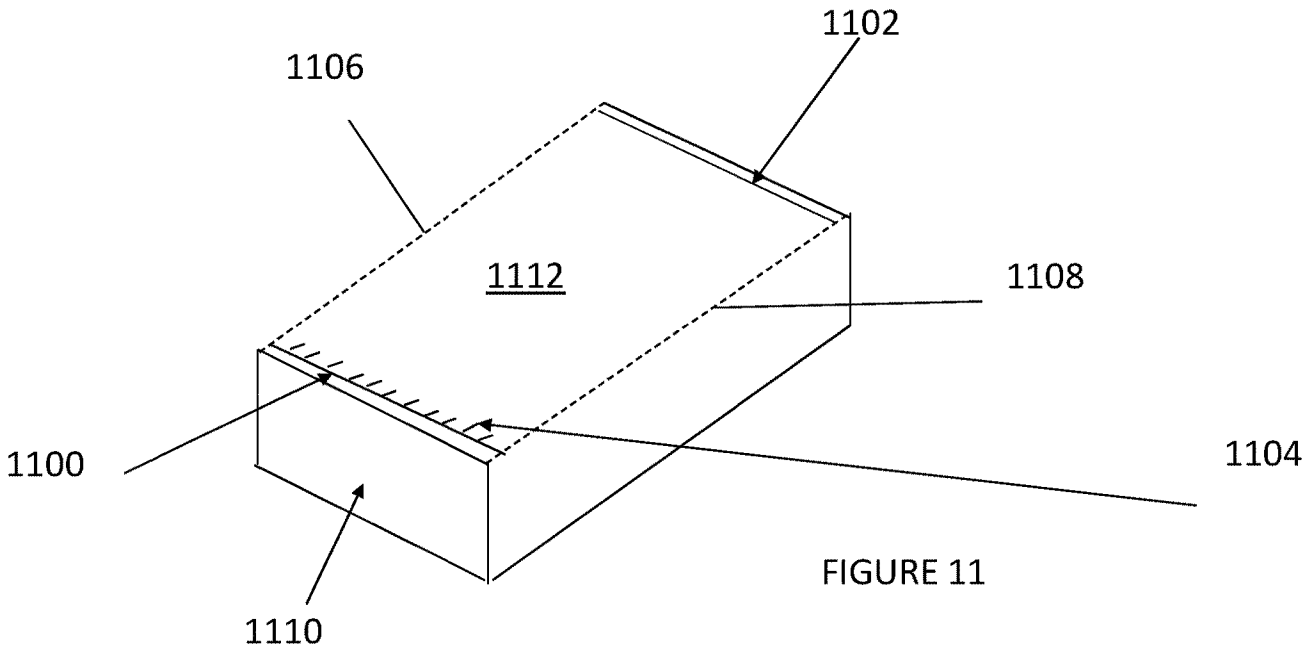
Figure 12:
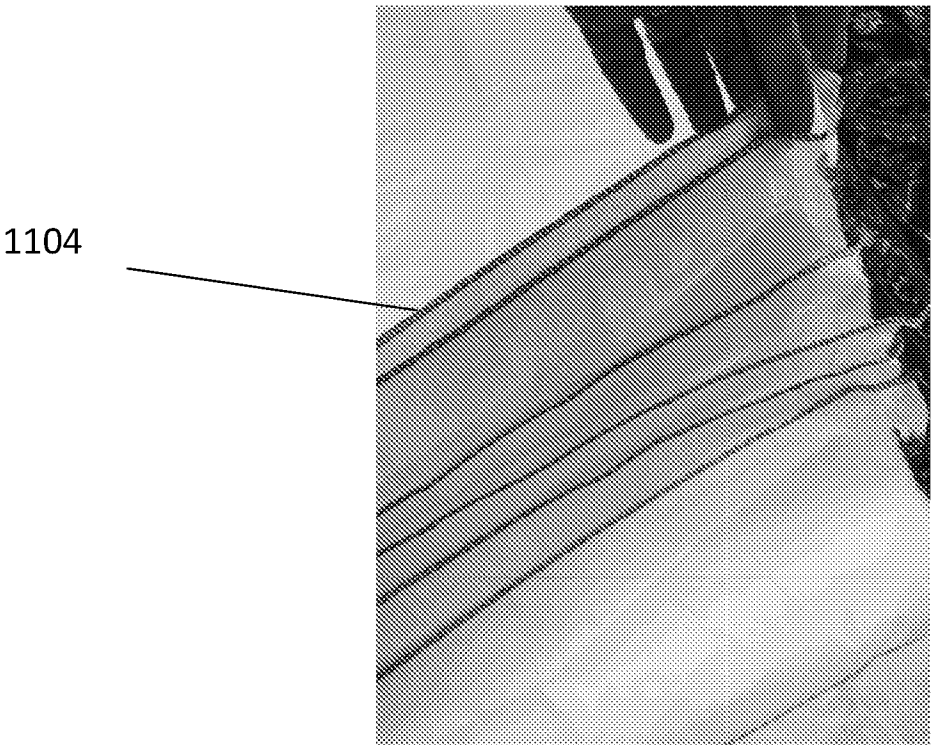

FIG. 11 depicts a preferred embodiment of the present invention. A layered mattress protector and sheet is provided with a bottom fitted portion (1110); at least three fitted sheet layers (1112), each fitted sheet layer having a top side (1100), bottom side (1102), right side (1108) and left side (1106) and an upper portion (1112) and lower portion (not seen in FIG. 11, would be the portion opposing the upper portion (1112) on the underneath of the three fitted sheet layers). Also note that the at least three fitted sheet layers are layered, so FIG. 11 only depicts one of the layers, but there are at least three fitted sheet layers, as depicted in other figures. There is a waterproof coating on the lower portion of each of the at least three fitted sheet layers (1112). The at least three fitted sheet layers (1112) are stitched along the right side (1106) and left side (1108) to the bottom fitted portion (1110) the stitch creating at least one perforation seam and the top side (1100) and bottom side (1102) are unstitched to the bottom fitted portion (1110) leaving open ends; and the top side (1100) is an edged top side (1104). It should be understood that the foregoing relates to preferred embodiments of the invention and that modifications may be made without departing from the spirit and scope of the invention as set forth in the following claims.

We claim:

1. A layered mattress protector and sheet, comprising:

a bottom fitted portion;

at least three fitted sheet layers, each fitted sheet layer having a top side, bottom side, right side and left side and an upper portion and lower portion;

a waterproof coating on the lower portion of each of the at least three fitted sheet layers;

the at least three fitted sheet layers comprising a plurality of inner sheet layers and a plurality of outer sheet layers;

wherein the plurality of outer sheet layers are stitched along the right side and the left side to the bottom fitted portion and the top side and bottom side are unstitched;

wherein each of the plurality of inner sheet layers are substantially rectangular and are defined by a plurality of perforations, each inner sheet layer further including an unperforated tab; and wherein the plurality of inner sheet layers are in a vertically stacked arrangement such that each of the inner sheet layers is defined by a greater area than that of an inner sheet layer of the plurality of inner sheet layers located immediately below.

2. A layered mattress protector as in claim 1, wherein the upper portion of each fitted sheet layer is rayon.

3. A layered mattress protector as in claim 1, wherein the edged top side is sewn with a rounded stitch.

4. A layered mattress protector as in claim 1, wherein the top side is a stitched to provide a stitched rolled hem top side.

5. A layered mattress protector as in claim 1, further comprising a printed item on the upper portion of the at least three fitted sheet layers.

6. A layered mattress protector as in claim 1, wherein the waterproof coating is a polyethylene coating.

7. A layered mattress protector and sheet, comprising:

a bottom fitted portion;

at least three fitted sheet layers, each fitted sheet layer having a top side, bottom side, right side and left side and an upper portion and lower portion and a plurality of inner sheet layers and a plurality of outer sheet layers;

a waterproof coating on the lower portion of each of the at least three fitted sheet layers;

wherein the at least three fitted sheet layers are stitched along at least the right side and left side to the bottom fitted and the top side and the bottom side are unstitched; and wherein each of the at least three fitted sheet layers has a tab cutout portion; and wherein the plurality of inner sheet layers are in a vertically stacked arrangement such that each of the inner sheet layers is defined by a greater area than that of an inner sheet layer of the plurality of inner sheet layers located immediately below.

8. A layered mattress protector as in claim 7, wherein the upper portion of each fitted sheet layer is rayon.

9. A layered mattress protector as in claim 7, wherein the tab cutout portion is along at least one of the top side, bottom side, right side and left side of the at least three fitted sheet layers.

10. A layered mattress protector as in claim 7, wherein the top side is sewn with a rounded stitch that edges the top side to provide an edged top side.

11. A layered mattress protector as in claim 1, wherein the top side is a stitched to provide a stitched rolled hem top side.

12. A layered mattress protector as in claim 1, further comprising a printed item on the upper portion of the at least three fitted sheet layers.

13. A layered mattress protector as in claim 1, wherein the waterproof coating is a polyethylene coating.

* * * * *